US008162672B2

(12) United States Patent
Huang

(10) Patent No.: US 8,162,672 B2
(45) Date of Patent: Apr. 24, 2012

(54) HIGH POWER RECEPTACLE CONNECTOR

(75) Inventor: Fu-Tang Huang, New Taipei (TW)

(73) Assignee: Jye Tai Precision Industrial Co., Ltd., New Taipei (TW)

( * ) Notice: Subject to any disclaimer, the term of this patent is extended or adjusted under 35 U.S.C. 154(b) by 0 days.

(21) Appl. No.: 13/015,114

(22) Filed: Jan. 27, 2011

(65) Prior Publication Data

US 2012/0058682 A1 Mar. 8, 2012

(30) Foreign Application Priority Data

Sep. 6, 2010 (TW) ..... 99217237 U

(51) Int. Cl.
*H01R 12/00* (2006.01)

(52) U.S. Cl. ..... 439/63; 439/607.27; 439/580; 439/668

(58) Field of Classification Search ..... 439/580, 439/63, 675, 668, 607.27, 607.28, 607.35, 439/607.36, 607.37, 607.4
See application file for complete search history.

(56) References Cited

U.S. PATENT DOCUMENTS

| | | | | |
|---|---|---|---|---|
| 4,983,127 | A * | 1/1991 | Kawai et al. | 439/79 |
| 6,623,277 | B1 * | 9/2003 | Zhu et al. | 439/63 |
| 6,695,644 | B2 * | 2/2004 | Zhao et al. | 439/580 |
| 6,932,614 | B1 * | 8/2005 | Kan | 439/580 |
| 7,086,867 | B2 * | 8/2006 | Nakagawa et al. | 439/63 |
| 7,108,514 | B2 * | 9/2006 | Chen et al. | 439/63 |
| 7,186,141 | B2 * | 3/2007 | Li et al. | 439/573 |
| 7,204,720 | B1 * | 4/2007 | Shiu | 439/668 |
| 7,318,749 | B2 * | 1/2008 | Li et al. | 439/580 |
| 7,597,583 | B2 * | 10/2009 | Zhuang | 439/490 |
| 7,604,513 | B2 * | 10/2009 | Wang et al. | 439/668 |
| 7,651,344 | B2 * | 1/2010 | Wu | 439/80 |
| 7,736,194 | B1 * | 6/2010 | Chang | 439/675 |
| 7,753,743 | B2 * | 7/2010 | Yang et al. | 439/752 |
| 7,914,344 | B2 * | 3/2011 | Tin et al. | 439/675 |
| 7,927,108 | B2 * | 4/2011 | Gong et al. | 439/63 |
| 2003/0203658 | A1 * | 10/2003 | Zhao et al. | 439/63 |
| 2005/0245104 | A1 * | 11/2005 | Nakagawa et al. | 439/63 |
| 2006/0258212 | A1 * | 11/2006 | Li et al. | 439/580 |
| 2008/0139043 | A1 * | 6/2008 | Wang et al. | 439/573 |
| 2009/0124135 | A1 * | 5/2009 | Zhuang | 439/668 |
| 2009/0215315 | A1 * | 8/2009 | Cheng | 439/607.28 |
| 2009/0253295 | A1 * | 10/2009 | Kameyama et al. | 439/607.27 |
| 2010/0105226 | A1 * | 4/2010 | Gong et al. | 439/135 |
| 2011/0111644 | A1 * | 5/2011 | Jin | 439/668 |
| 2011/0143603 | A1 * | 6/2011 | Huang et al. | 439/675 |

* cited by examiner

*Primary Examiner* — Ross Gushi
(74) *Attorney, Agent, or Firm* — patenttm.us

(57) ABSTRACT

A high power receptacle connector has a first insulating housing, a second insulating housing, a first terminal, a second terminal, a third terminal and a shell. The second insulating housing is mounted on the first insulating housing and has a cylinder. The first terminal is cylindrical, surrounds the cylinder and has multiple first resilient contacting tabs and a reinforcing ring formed on front ends of the first resilient contacting tabs. The second terminal is cylindrical and mounted around the cylinder and has multiple radially protruding second resilient contacting tabs. The second resilient contacting tabs increase the contacting areas, reduce the resistance of the terminals and further improve the power of the high power receptacle connector and stably hold an external plug connector.

7 Claims, 6 Drawing Sheets

HIGH POWER RECEPTACLE CONNECTOR

BACKGROUND OF THE INVENTION

1. Field of the Invention

The present invention relates to a connector, and more particularly to a high power receptacle connector that improves contacting capability with other connectors connected to the high power receptacle connector and prevents power/signal transmission failure or unusual increase of the resistance. Therefore, high power signal transmission is achieved.

2. Description of Related Art

Connectors are common electrical components of electronic devices. Different electronic devices are connected to each other by connectors so that signal transmission is implemented between different electronic devices to further incorporate these electronic devices into a specific electronic system.

The semiconductor industries are rapidly developed in recent years so that electronic devices have high-speed and high-performance built-in processing chips to fulfill user's demand. Also, the connectors of the electronic devices need to cooperate with the processing chips to transmit high power signals. However, conventional connectors cannot afford transmission high power signals so that the connector manufacturers constantly develop new high power connectors.

To overcome the shortcomings, the present invention provides a high power receptacle connector to mitigate or obviate the aforementioned problems.

SUMMARY OF THE INVENTION

The main objective of the invention is to provide a high power receptacle connector that improves contacting capability with other connectors connected thereto and prevents power/signal transmission failure or unusual increase of the resistance. Therefore, high power signal transmission is achieved.

A high power receptacle connector in accordance with the present invention comprises a first insulating housing, a second insulating housing, a first terminal, a second terminal, a third terminal and a shell. The second insulating housing is mounted on the first insulating housing and has a cylinder. The first terminal is cylindrical, surrounds the cylinder and has multiple first resilient contacting tabs and a reinforcing ring formed on front ends of the first resilient contacting tabs. The second terminal is cylindrical and mounted around the cylinder and has multiple radially protruding second resilient contacting tabs. The second resilient contacting tabs increase the contacting areas, reduce the resistance of the terminals and further improve the power of the high power receptacle connector and stably hold an external plug connector.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
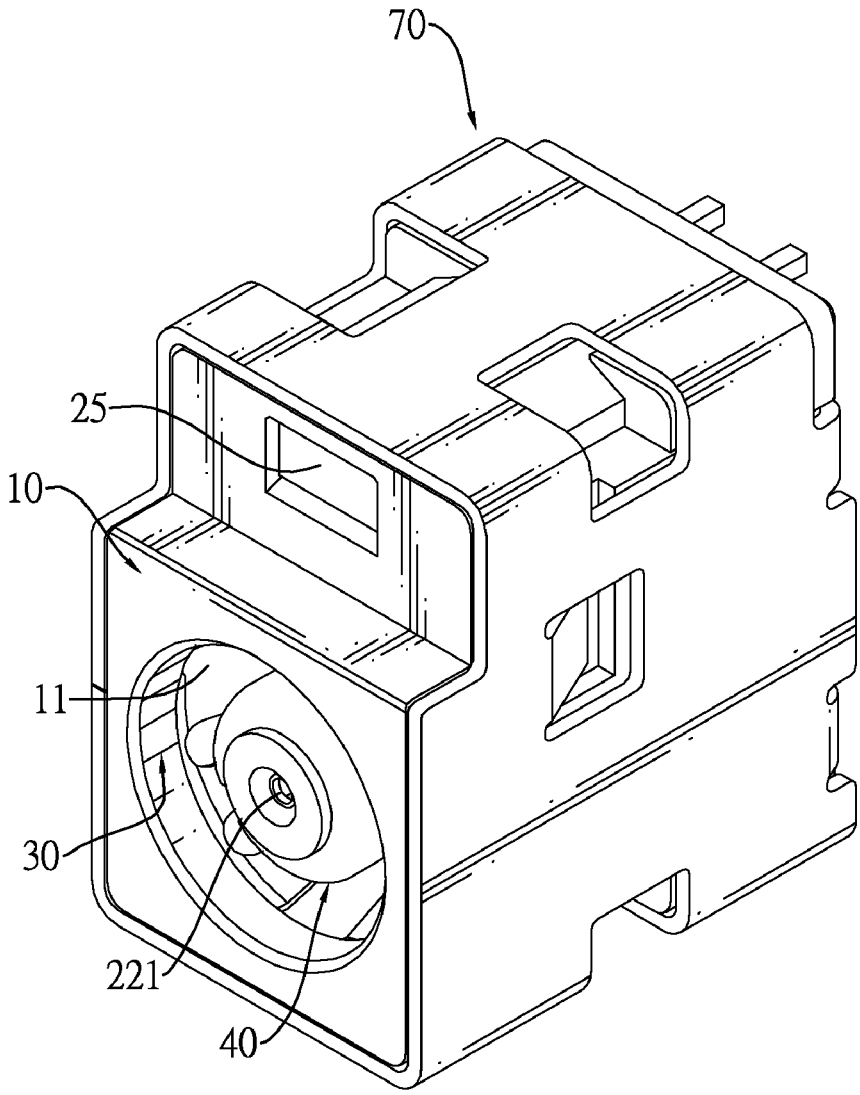
FIG. 1 is a perspective view of a high power receptacle connector in accordance with the present invention.
Figure 2:
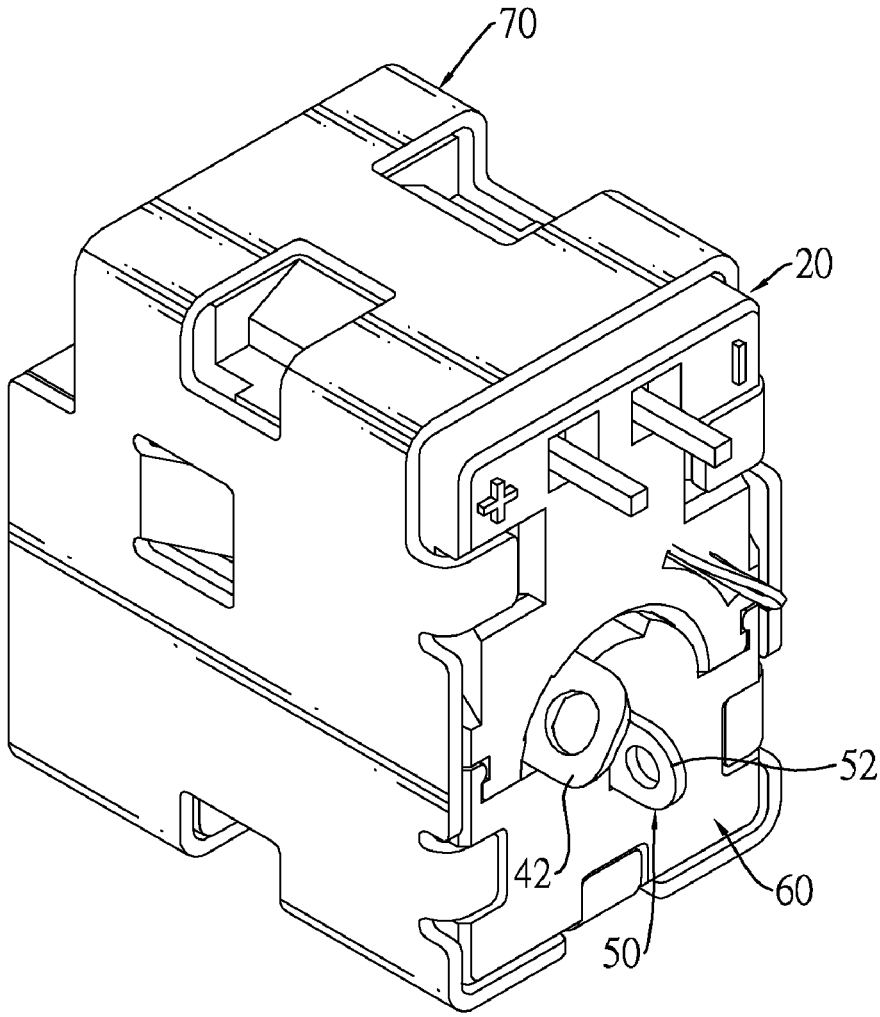
FIG. 2 is another perspective view of the high power receptacle connector in FIG. 1.
Figure 3:
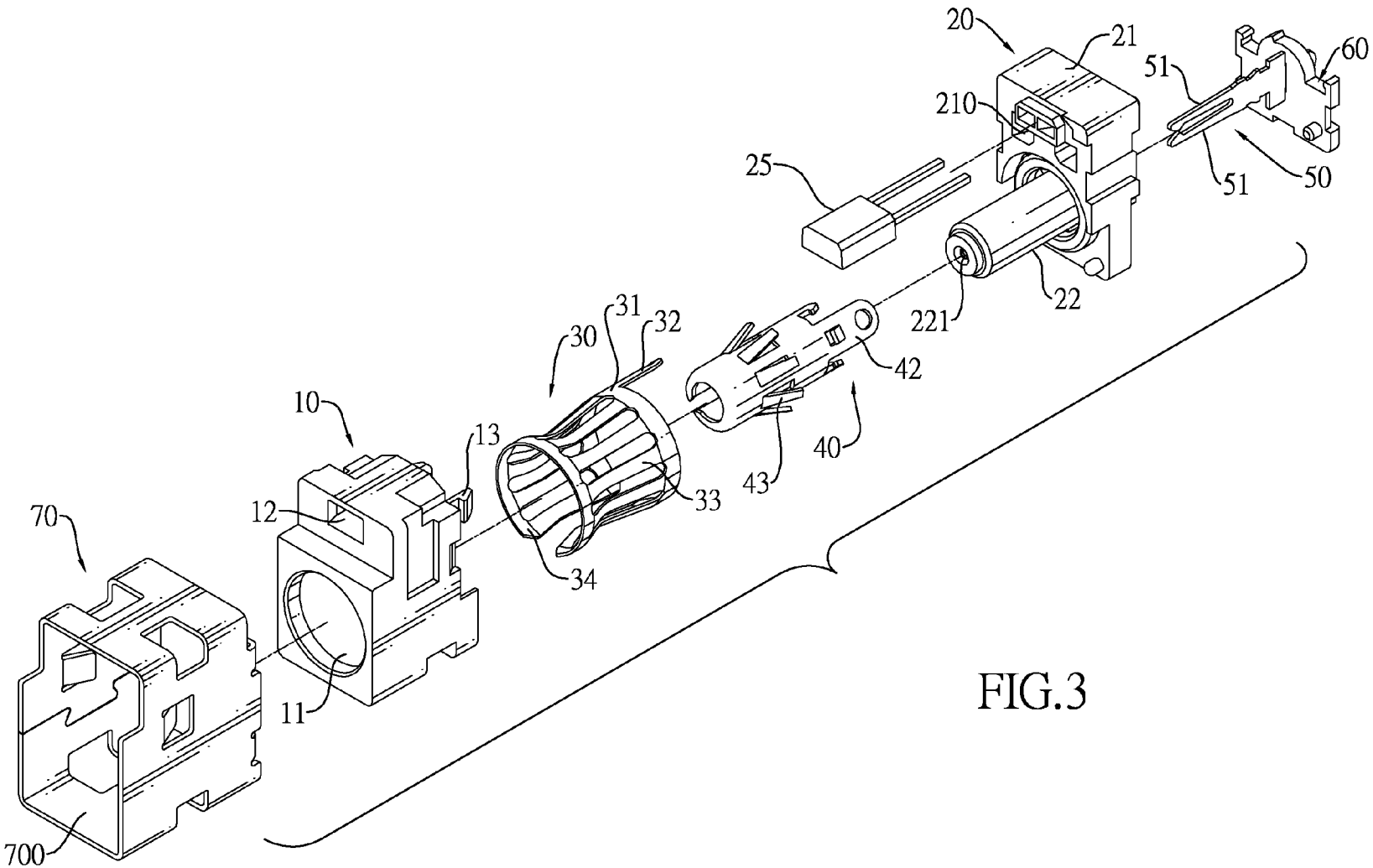
FIG. 3 is an exploded perspective view of the high power receptacle connector in FIG. 1.
Figure 4:
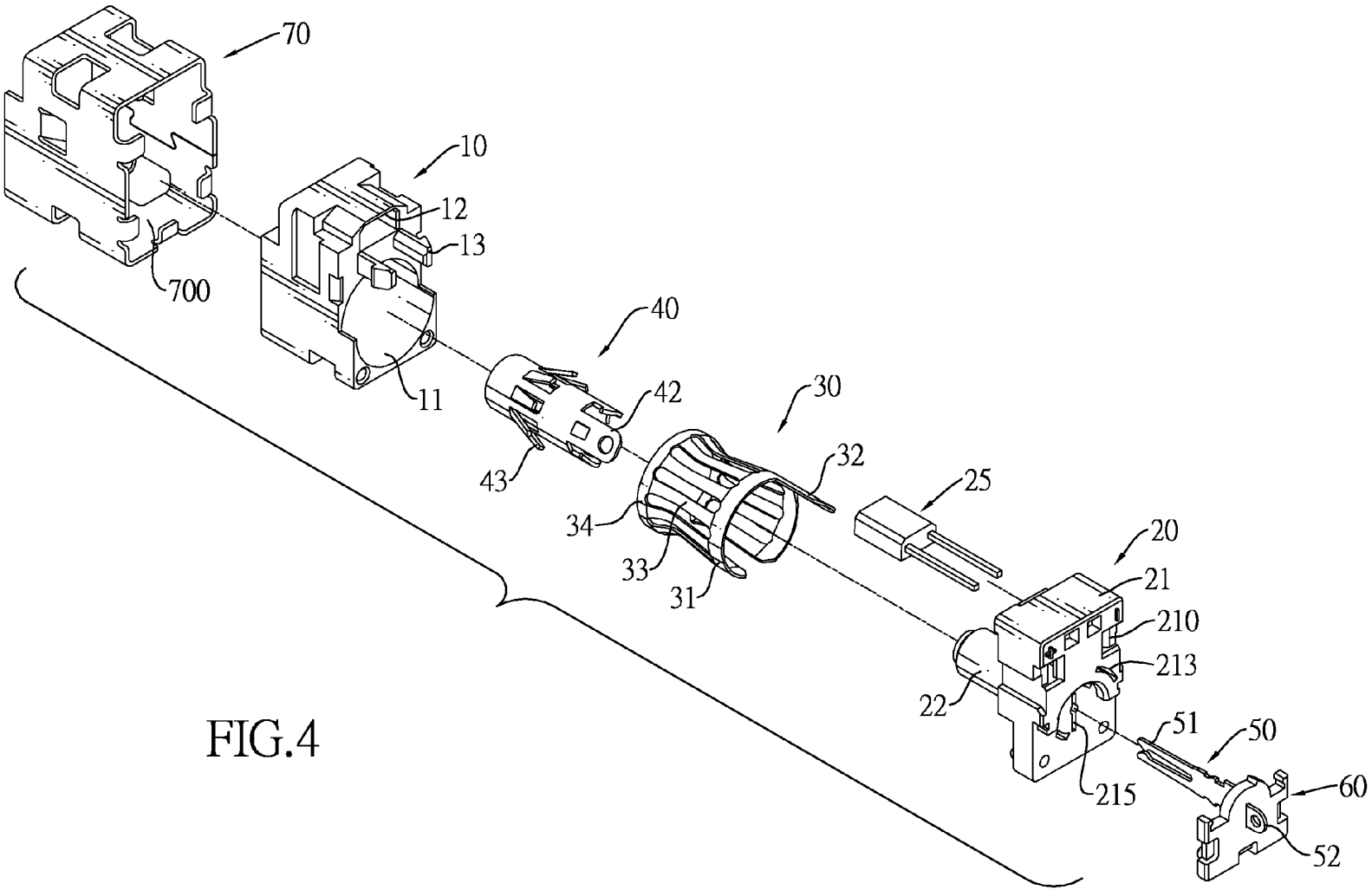
FIG. 4 is another exploded perspective view of the high power receptacle connector in FIG. 2.

With reference to FIGS. 1 to 4, a high power receptacle connector in accordance with the present invention comprises a first insulating housing (10), a second insulating housing (20), a first terminal (30), a second terminal (40), a third terminal (50), a shell (70) and a mounting bracket (60).

The first insulating housing (10) has a front end, a rear end, a cavity (11), two hooks (13) and an assembling hole (12).

The cavity (11) is defined longitudinally through the first insulating housing (10).

The hooks (13) are formed on and protrude backward from the rear end of the first insulating housing (10).

The assembling hole (12) is defined longitudinally through the first insulating housing (10) above the cavity (11).

Figure 5:
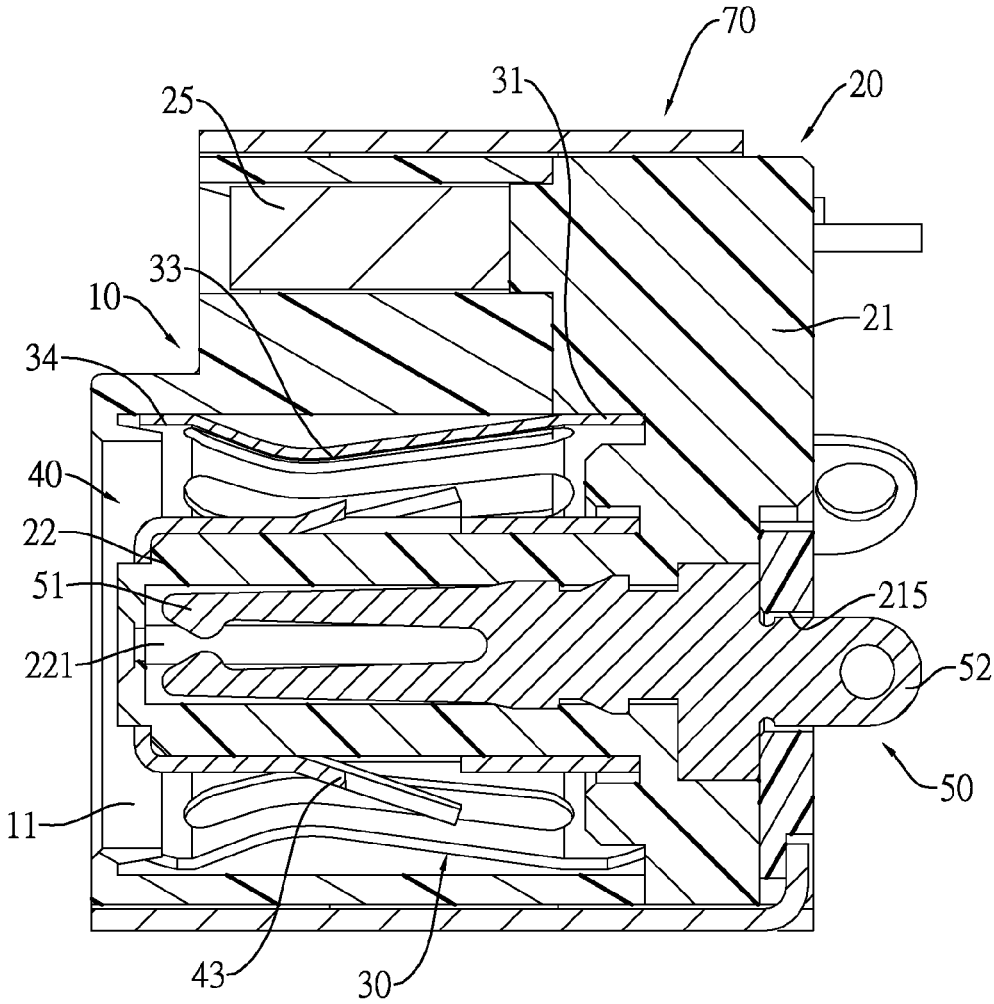
FIG. 5 is a cross sectional side view of the high power receptacle connector in FIG. 1.
Figure 6:
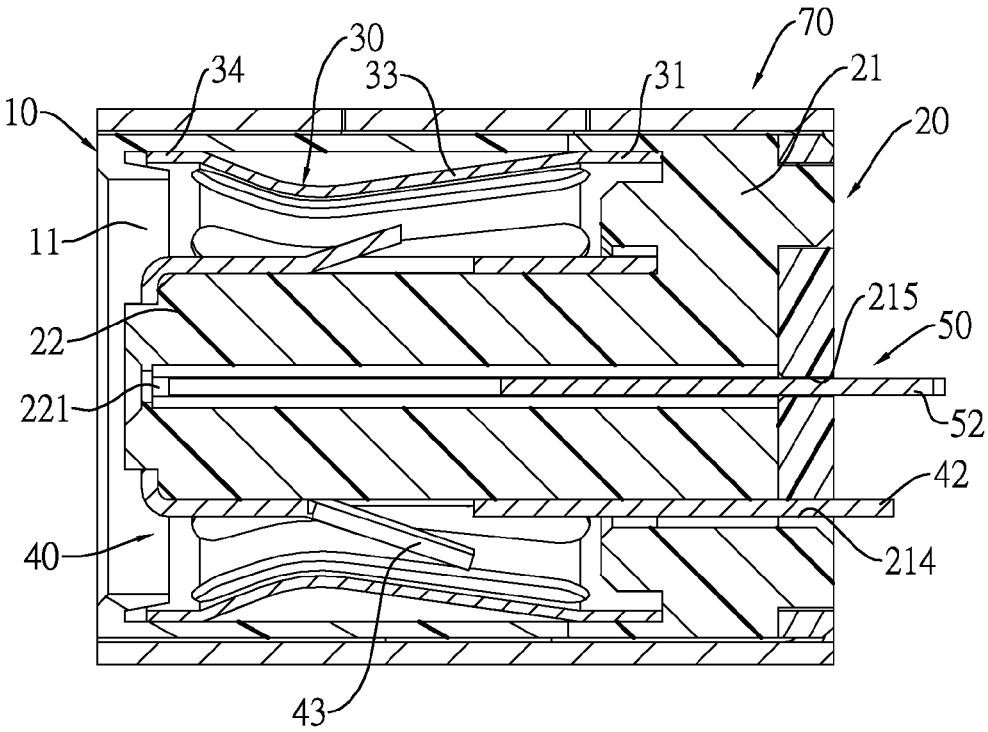
FIG. 6 is a cross sectional top view of the high power receptacle connector in FIG. 1.

With further reference to FIGS. 5 and 6, the second insulating housing (20) is mounted on the rear end of the first insulating housing (10) and has a front end, a rear end, a base (21), a cylinder (22) and a light-emitting element (25).

The base (21) has a front, a rear, two hooking holes (210) and three mounting holes (213, 214, 215). The hooking holes (210) are defined longitudinally through the base (21) and respectively hook around the hooks (13) of the first insulating housing (10). The mounting holes (213, 214, 215) are defined longitudinally through the base (21).

The cylinder (22) is formed on and protrudes forward from the front of the base (21), extends in the cavity (11) of the first insulating housing (10) and has a through hole (221) defined longitudinally through the cylinder (22).

The light-emitting element (25) may be a light-emitting diode, is mounted in the assembling hole (12) of the first insulating housing (10).

The first terminal (30) is cylindrical, is mounted on the front end of the second insulating housing (20), surrounds the cylinder (22) and has an annular mounting tab (31), multiple resilient contacting tabs (33), a reinforcing ring (34) and a first soldering section (32).

The annular mounting tab (31) is mounted on the front end of the second insulating housing (20).

The first resilient contacting tabs (33) are formed on and protrude forward from the annular mounting tab (31) and are arranged at intervals. Each first resilient contacting tab (33) has a front end.

The reinforcing ring (34) is formed on the front ends of the first resilient contacting tabs (33).

The first soldering section (32) is formed on and protrudes backward from the annular mounting tab (31) and is mounted through one mounting hole (213) of the second insulating housing (20).

The second terminal (40) is cylindrical, is mounted around the cylinder (22) of the second insulating housing (20), is surrounded by the first terminal (30), is arranged at an interval from the first terminal (30) and has multiple second resilient contacting tabs (43) and a second soldering section (42).

The second resilient contacting tabs (43) are formed on and protrude obliquely and radially outward from the second terminal (40).

The second soldering section (42) is formed on and protrudes backward from the second terminal (40) and is mounted through one mounting hole (214) of the second insulating housing (20).

The third terminal (50) is elongated, is mounted through the base (21) of the second insulating housing (20), extends forward in the through hole of the cylinder (22) and has two prongs (51) and a third soldering section (52).

The prongs (51) are formed on and protrude forward from the third terminal (50) and extend in the through hole (221) of the cylinder (22).

The third soldering section (52) is formed on and protrudes backward from the third terminal (50) and is mounted through one mounting hole (215) of the second insulating housing (20).

The shell (70) has an accommodating space (700) defined in the shell (70) and receiving the first insulating housing (10), second insulating housing (20), first terminal (30), second terminal (40) and third terminal (50).

The mounting bracket (60) is mounted on the rear end of the second insulating housing (20), may be mounted on the rear of base (21) and is mounted around the third soldering section (52) of the third terminal (50).

The high power receptacle connector in accordance with the present invention has the following advantages:

1. The reinforcing ring (34) mounted on the front ends of the first resilient contacting tabs (33) of the first terminal (30) improves the resilience of the first resilient contacting tabs (33) and reduce the metal fatigue of the same.
2. The second resilient contacting tabs (43) of the second terminal (40) may tightly contacts terminals of an external plug connector and increase the contacting areas therebetween to stably implement high power signal transmission between the connectors.
3. The second resilient contacting tabs (43) of the second terminal (40) may correspond to the first resilient contacting tabs (33) of the first terminal (30) to provide stronger contacting force to the terminals of the external plug connector.
4. The first and second resilient contacting tabs (33, 43) has sufficiently large surface area to conduct current so that the resistance of the first and second terminals (30, 40) are effectively decreased.
5. The aforementioned structures of the present invention reduce the total resistance and improve power of the high power receptacle connector.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A high power receptacle connector comprising:

a first insulating housing having a front end, a rear end and a cavity defined through the first insulating housing;

a second insulating housing mounted on the rear end of the first insulating housing and having a front end and a rear end and further having a base having a front and a rear; and a cylinder formed on and protruding forward from the front of the base and extending in the cavity of the first insulating housing;

a first terminal being cylindrical, mounted on the front end of the second insulating housing, surrounding the cylinder and having an annular mounting tab mounted on the front end of the second insulating housing;

multiple first resilient contacting tabs formed on and protruding forward from the annular mounting tab and arranged at intervals, and each first resilient contacting tab having a front end; and a reinforcing ring formed on the front ends of the first resilient contacting tabs;

a second terminal being cylindrical, mounted around the cylinder of the second insulating housing, surrounded by the first terminal, arranged at an interval from the first terminal and having multiple second resilient contacting tabs formed on and protruding obliquely and radially outward from the second terminal;

a third terminal mounted through the base of the second insulating housing and extending forward in the cylinder; and a shell having an accommodating space defined in the shell and receiving the first insulating housing, second insulating housing, first terminal, second terminal and third terminal.

2. The high power receptacle connector as claimed in claim 1, wherein the cylinder of the first insulating housing has a through hole defined through the cylinder so that the third terminal extends in the through hole.

3. The high power receptacle connector as claimed in claim 2, wherein the third terminal has two prongs formed on and protruding forward from the third terminal and extending in the through hole of the cylinder.

4. The high power receptacle connector as claimed in claim 2, wherein the second insulating housing has through mounting holes defined through the second insulating housing;

the first terminal further has a first soldering section formed on and protruding backward from the annular mounting tab;

the second terminal further has a second soldering section formed on and protruding backward from the second terminal;

the third terminal further has a third soldering section formed on and protruding backward from the third terminal; and the first, second and third soldering sections are mounted respectively the mounting holes of the second insulating housing.

5. The high power receptacle connector as claimed in claim 2, wherein the first insulating housing further has an assembling hole defined through the first insulating housing; and a light-emitting element is mounted in the assembling hole of the first insulating housing.

6. The high power receptacle connector as claimed in claim 2, wherein a mounting bracket is mounted on the rear end of the second insulating housing and is mounted around the third soldering section of the third terminal.

7. The high power receptacle connector as claimed in claim 2, wherein the first insulating housing further has two hooks formed on and protruding backward from the rear end of the first insulating housing; and the base of the second insulating housing further has two hooking holes defined through the base and respectively hooking around the hooks of the first insulating housing.

* * * * *